US007243701B2

(12) United States Patent
Dvoskin et al.

(10) Patent No.: US 7,243,701 B2
(45) **Date of Patent: *Jul. 17, 2007**

(54) TREATING MOLTEN METALS BY MOVING ELECTRIC ARC

(75) Inventors: Pavel Dvoskin, Netanya (IL); Valery Zlochevsky, Netanya (IL); Emil Rodjak, Netanya (IL); Dror Nadam, Eyn-Sarid (IL)

(73) Assignee: Netanya Plasmatec Ltd., Netanya South (IL)

( * ) Notice: Subject to any disclaimer, the term of this patent is extended or adjusted under 35 U.S.C. 154(b) by 0 days.

This patent is subject to a terminal disclaimer.

(21) Appl. No.: 10/450,269

(22) PCT Filed: Dec. 12, 2001

(86) PCT No.: PCT/IL01/01150

§ 371 (c)(1),
(2), (4) Date: Sep. 30, 2003

(87) PCT Pub. No.: WO02/47850

PCT Pub. Date: Jun. 20, 2002

(65) Prior Publication Data

US 2005/0098298 A1 May 12, 2005

(30) Foreign Application Priority Data

Dec. 12, 2000 (IL) ..... 140246

(51) Int. Cl.
*B22D 27/02* (2006.01)
*B22D 27/04* (2006.01)
*B22D 27/06* (2006.01)

(52) U.S. Cl. ..... 164/469; 164/495; 164/508; 164/514

(58) Field of Classification Search ..... 164/469–470, 164/495–496, 508–509, 514–515, 359–360, 164/122

See application file for complete search history.

(56) References Cited

U.S. PATENT DOCUMENTS 3,152,372 A 10/1964 Hopkins (Continued)

FOREIGN PATENT DOCUMENTS

CN 1067398 12/1992

(Continued)

OTHER PUBLICATIONS

V. Abramov et al. "Solidification of aluminium alloys under ultrasonic irradiation using water-cooled resonator", Material Letters 37, 1998, pp. 27-34.

(Continued)

*Primary Examiner*—Kuang Y. Lin
(74) *Attorney, Agent, or Firm*—Pearl Cohen Zedek Latzer, LLP

(57) ABSTRACT

An apparatus (10) and a method for reducing inclusions, shrinkage blowholes, porosity and segregation in metal castings during the casting process, and for improving the grain structure, mechanical properties and yield of ingots and other castings. The apparatus (10) comprises: At least one electrode (14) for forming a moving electric arc (16) over the upper surface (18) of a metallic casting (12) being cast and a stand (20) for suspending the electric arc electrode (14) over the upper surface (18) of the metallic casting (12) during or after pouring and a second electrode (24) attachable to a metallic surface (26) of the mold (28) being used for casting, for completion of an electric circuit (30) including the electric arc (16) and electronic controls (32) connected between the apparatus (10) and a power supply (34).

11 Claims, 17 Drawing Sheets

U.S. PATENT DOCUMENTS

| | | | | | |
|---|---|---|---|---|---|
| 3,377,418 | A | * | 4/1968 | De Corso et al. | 373/90 |
| 3,546,348 | A | | 12/1970 | DeCorso | |
| 3,586,749 | A | * | 6/1971 | Iodkovsky et al. | 373/42 |
| 3,597,519 | A | * | 8/1971 | Kemeny et al. | 373/85 |
| 3,617,596 | A | * | 11/1971 | DeCorso | 373/77 |
| 3,680,163 | A | | 8/1972 | De Corso | |
| 3,696,859 | A | * | 10/1972 | Cooper | 164/495 |
| 3,776,294 | A | * | 12/1973 | Paton et al. | 75/10.24 |
| 3,865,174 | A | * | 2/1975 | Buehl | 164/495 |
| 3,867,976 | A | * | 2/1975 | Suarez et al. | 164/497 |
| 3,920,063 | A | * | 11/1975 | Sasaki et al. | 164/55.1 |
| 3,947,265 | A | | 3/1976 | Guzowski et al. | |
| 4,017,672 | A | * | 4/1977 | Paton et al. | 373/21 |
| 4,042,007 | A | | 8/1977 | Zavaras et al. | |
| 4,132,545 | A | | 1/1979 | Rabinovich et al. | |
| 4,167,963 | A | | 9/1979 | Marianeschi et al. | |
| 4,192,370 | A | | 3/1980 | Rablnovich et al. | |
| 4,307,280 | A | | 12/1981 | Ecer | |
| 4,427,052 | A | * | 1/1984 | Garfinkle | 164/495 |
| 4,478,273 | A | * | 10/1984 | Hanas | 164/468 |
| 4,528,673 | A | * | 7/1985 | Stenkvist | 373/108 |
| 4,645,534 | A | | 2/1987 | D'Angelo et al. | |
| 4,749,026 | A | | 6/1988 | Metz et al. | |
| 4,756,749 | A | | 7/1988 | Praitoni et al. | |
| 4,770,724 | A | | 9/1988 | Lowry et al. | |
| 4,862,477 | A | | 8/1989 | Olds et al. | |
| 4,970,435 | A | | 11/1990 | Tanaka et al. | |
| 5,273,101 | A | | 12/1993 | Lillquist et al. | |
| 5,285,563 | A | | 2/1994 | Nove et al. | |
| 5,963,579 | A | | 10/1999 | Henryon | |
| 6,169,265 | B1 | | 1/2001 | Dvoskin et al. | |

FOREIGN PATENT DOCUMENTS

| | | | |
|---|---|---|---|
| EP | 0 518 537 A | | 12/1992 |
| JP | 54-68724 | * | 6/1979 |
| JP | 56050705 | | 5/1981 |
| JP | 61-17352 | * | 1/1986 |
| WO | WO 89/07499 A | | 8/1989 |
| WO | WO 97/28672 | | 8/1997 |

OTHER PUBLICATIONS

A. Drevermann et al., "Online process control for directional solidification by ultrasonic pulse echo technique", Ultrasonics xxxx, 2004, 1-4.

R.M. Khristinich et al., "Molten Metal Electromagnetic Stirring in Metallurgy", Modelling for Electromagnetic Processing, Hannover, Mar. 24-26, 2003, pp. 29-34.

H. Behrens et al., "Electromagnetic Sealing of Zinc Melt at the CVGL Process", International Scientific Colloquium, Modelling for Electromagnetic Processing, Hannover, Mar. 24-26, 2003. pp. 35-36.

"Induction Stirring Technology", SMS Elotherm—Induction stirring of Aluminium Alloys, http://www.elotherm.de/englisch/html/header_ruhren.html.

"Continuous and Static Casting with Ultrasound", MP Interconsulting, http://www.mpi-ultrasonics.com/metal-casting.html, Apr. 2004, p. 1.

N. Ei-Kaddah et al., "Electromagnetic Stirring of Steel: Effect of Stirrer Design on Mbdng in Horizontal Electromagnetic Stirring of Steel Slabs", Second International Conference on CFD in the Minerals and Process Industries CSIRO, Melbourne, Australia, Dec. 6-8, 1999, pp. 339-344.

Modular Mould Electromagnetic Stirrer, 2005, http://www.abb.com/global/seapr/seapr035.nsf/0/89ca621e6090fl04c12568c50033f.

International Search Report for PCT/IL01/01150 mailed May 9, 2002.

International Search Report for PCT/IL02/00686 mailed Feb. 6, 2003.

International Search Report for PCT/IL02/00584 mailed Dec. 4, 2002.

Moore C. et al: "Plasma Tundish Heating as an Integral Part of Continuous Casting" Steel Times International, DMG World Media, Lewes, GB, vol. 13, No. 2, May 1, 1989, pp. 44-46.

European Search Report for EP 02 76 0539 mailed on Nov. 4, 2005.

Chinese Office Action for Chinese patent application No. 01822576 4, mailed on Dec. 1, 2005.

Chinese Office Action for Chinese patent application No. 01822576. 4, mailed on May 25, 2005.

Brief Description of Russian article by Zlotevsky, Sterling et al.

European Supplementary Partial Search Report for EP 01 27 0396.

* cited by examiner

Microstructure of 10 ton tool steel ingot. Center. Etching. M x 50

Microstructure of 10 Kg AlSi10Mg ingot. Top. Etching. M x 125

Metal Hardness variation in Conventional and Plasma Treated 1.6 ton steel ingots after cast The Plasma Treated cast Mass of cast 310 kg.

Mass of riser 26 kg. (reduced by 82%)

The Conventional cast

Mass of cast 310 kg.

Mass of riser 140 kg.

PTC Reduces the risers mass by 73% from 16.8 to 4.5 Kg

TREATING MOLTEN METALS BY MOVING ELECTRIC ARC

FIELD OF THE INVENTION

The present invention relates to improvements in the casting of both ferrous and non-ferrous metals.

More particularly, the invention provides an apparatus and a method for reducing inclusions, shrinkage blowholes, porosity and segregation in metal castings during the casting process, and for improving the grain structure, mechanical properties and yield of ingots and other castings.

While metals have been cast for thousands of years, certain difficulties in producing perfect gravity castings have remained until the present day. During the casting process, as liquid metal is poured into a casting mold, the liquid cools and solidifies firstly in proximity to the mold walls and later also in the casting center. Because the cooling process is accompanied by substantial contraction, a void or voids, referred to as shrinkage blowholes, are formed in the casting, typically in its upper central region. In steel production, shrinkage blowholes cause the rejection of the top 5–20% of the ingot, which is cut off and discarded. One attempt at reducing the loss caused by shrinkage blowholes is to partially deoxidize mild steel in the ladle, so that shrinkage blowhole is transformed to numerous distributed stall blowholes which can be later closed by rolling. The more general solution for this problem is the use of exothermic or isolation hot top, either by plates or by powder. The hot top allows maintaining a molten metal reservoir at the ingot's top, in order to feed the blowholes in molten metal.

A similar type of wastage occurs during normal sand casting. In order to ensure that the mold is completely filled, several large risers are used to facilitate metal entry into the mold. Before the casting leaves the foundry the risers are cut off and discarded. A further effect in metal alloys casting is the forming during cooling of dendrites, these being formed during solidification as various points in the melt mass take up a lattice structure. During the formation of dendrites, impurities, such as metallic oxides and nitrides are pushed outwards to form a crystal grain boundary, these later forming a site for the initiation of cracks in a finished component. A concentration of these impurities is referred to as inclusions. Careful mold design and lower pouring temperatures can to some extent combat this.

Gases, from the atmosphere or other sources are also present in the liquid metal, these being the main cause of casting porosity. Inclusions of hydrogen, oxygen and other gases can be much reduced by casting liquid alloys in a vacuum chamber, but the process is only economic for the production of highest quality alloys.

Continuous casting is today the major method for producing long metal ingots (billets, blooms and slabs), which are cut to any required length after solidification is complete. In the most-used system, metal is poured continuously from a tundish into a water-cooled mold. The cast rod is advanced by means of rollers and cooled by water jets. The problems of porosity, impurities, cracks and coarse grain size can all appear also with this method, and much effort has been made to combat these problems.

In U.S. Pat. No. 4,307,280 Ecer discloses a method of filling casting voids after they have already been formed. The void needs to be detected and mapped, after which the casting is pressed between two electrodes and a current sufficient to cause local melting near the void is applied. The internal void is said to be collapsed thereby and migrates to the surface to cause a dimple that can be filled. The method is of course inapplicable to the elimination of solid inclusions such as sulfides and silicates.

Applying roller pressure to the ingot during continuous casting is proposed by Fukuoka et al. in Japanese Patent no. JP56050705A2. Pressure is said to prevent the generation of a crack on the bottom side of the casting groove. The roller is located at the point where the bent ingot is straightened. Obviously this process is of no help in reducing inclusions or in improving the microstructure of the metal.

Lowry et al in U.S. Pat. No. 4,770,724 describe an unusual continuous casting method for metals which claims to eliminate voids and flaws and to produce a dense homogeneous product. This is achieved by forcing the metal to flow upwards, against gravity, by means of an electromagnetic field that also provides containment forces. As this process is limited to a small cross section, and can not be applied on large ingots slabs or blooms.

OBJECTS OF THE INVENTION

It is therefore one of the objects of the present invention to obviate the disadvantages of prior art casting methods and to provide an improved method and an apparatus for producing better quality ingots and other castings.

It is a further object of the present invention to provide an apparatus that will break up dendrites into small pieces and thereby, reduce the grain size of the finished casting. Yet a further object of the present invention is to stir the liquid metal during solidification to improve homogeneity and to allow light-density inclusions and gases to rise to the surface of the casting.

SUMMARY OF THE INVENTION

The present invention achieves the above objects by providing an apparatus for reducing shrinkage blowholes, inclusions, porosity and grain size in metallic castings and for improving homogeneity therein, said apparatus comprising:

a) at least one electrode for forming a moving electric arc over the upper surface of a metallic casting being cast;

b) a stand for suspending said electric arc electrode over the upper surface of said metallic casting during or after pouring;

c) a second electrode attachable to a metallic surface of the mold being used for casting, for completion of an electric circuit including said electric arc; and d) electronic controls connected between said apparatus and a power supply.

In a preferred embodiment of the present invention there is provided an electric arc casting apparatus wherein multiple electrodes are provided, each electrode being positionable over at least one of the risers of a sand or permanent mold casting for producing separate moving electric arcs over each riser.

In a preferred process of the present invention there is provided a method for reducing shrinkage blowholes, inclusions, porosity and grain size in metallic castings and for improving homogeneity and yield therein, said method comprising step a) pouring a liquid metal into a mold;

step b) providing a electric arc electrode and positioning same slightly above the upper surface of the molten metal;

step c) applying an electric current to the electrode to form an arc between said electrode and the upper surface of the liquid metal so as to stir the liquid metal, to break coarse dendrites if present, and to maintain a central molten pool of metal to fill voids forming in the casting due to cooling shrinkage; and step d) continually moving the electric arc over the upper surface by applying an electric current.

Yet further embodiments of the method and the apparatus invention will be described hereinafter.

In U.S. Pat. No. 4,756,749 Praitoni et al. there is described and claimed a process for the continuous casting of steel from a tundish having several casting spouts. While in the tundish, the steel is subjected to further heating, which in claim 5 is a transferred arc plasma torch Henryon, in U.S. Pat. No. 5,963,579 describes a similar process. Absorption of gas can reoccur while metal is poured from the tundish to the mold, and no solution to porosity and segregation is provided.

In contradistinction thereto, the present invention describes a method and apparatus for applying a moving electric arc directly to the upper surface of the casting during solidification. The advantages of such arrangement, which have been stated, result from stirring the metal in the mold during casting itself. Such stirring just prior to solidification breaks up coarse dendrites into smaller solids, as seen in FIG. 9, and thus improves grain structure. Stirring also allows gas bubbles rise to the top of the liquid and to escape. Shrinkage blowholes are eliminated completely, and concentrations of impurities are broken up and dispersed.

It will thus be realized that the novel apparatus of the present invention serves to greatly improve the quality and homogeneity of castings, and to achieve more consistent hardness therein, as will be clearly evident from comparative photographs and further data which will be seen in the figures.

It is to be stressed that the method and apparatus to be described have been tested in practice. For example, a 12-head apparatus for the sand casting of cylinder heads in accordance with the claims of the present invention has been built and operated to meet the objects of the invention. An example of riser volume reduction and increase casting productivity will also be seen in FIG. 15.

BRIEF DESCRIPTION OF THE DRAWINGS

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

In the drawings.

DETAILS DESCRIPTION OF THE INVENTION

Figure 1:
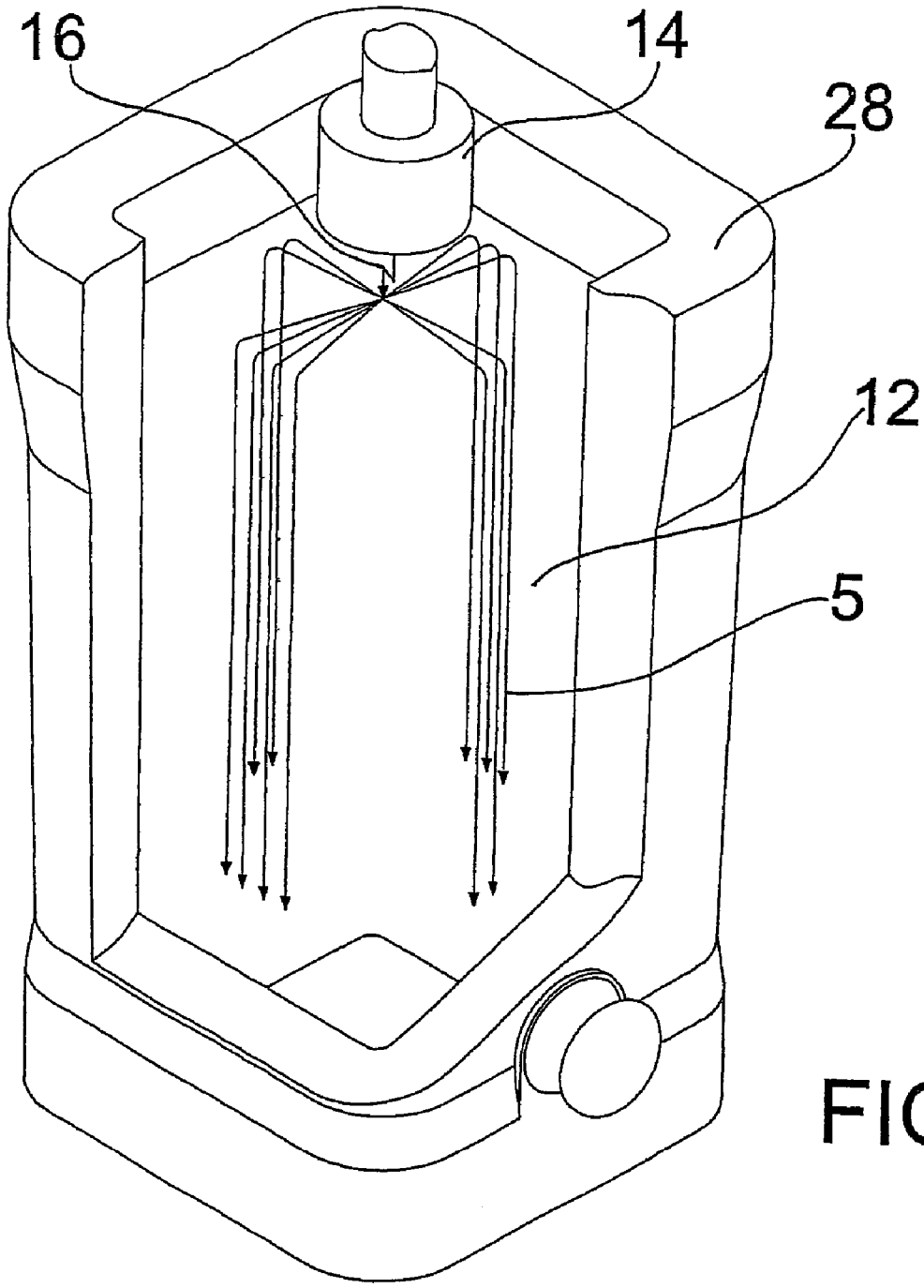
FIG. 1 is a detail view of the electric arc electrode applying electric arc over liquid metal in a mold, and a schematic view showing distribution of electric currents flux in a casting.

Turning first to FIG. 1 which is a detailed view of the electric arc electrode 14 applying an electric arc 16 on liquid metal 12 in a mold 28 and thus creating a distribution of electric currents flux 5 in the casting. This is the basic principle which effects the casting.

Figure 2:
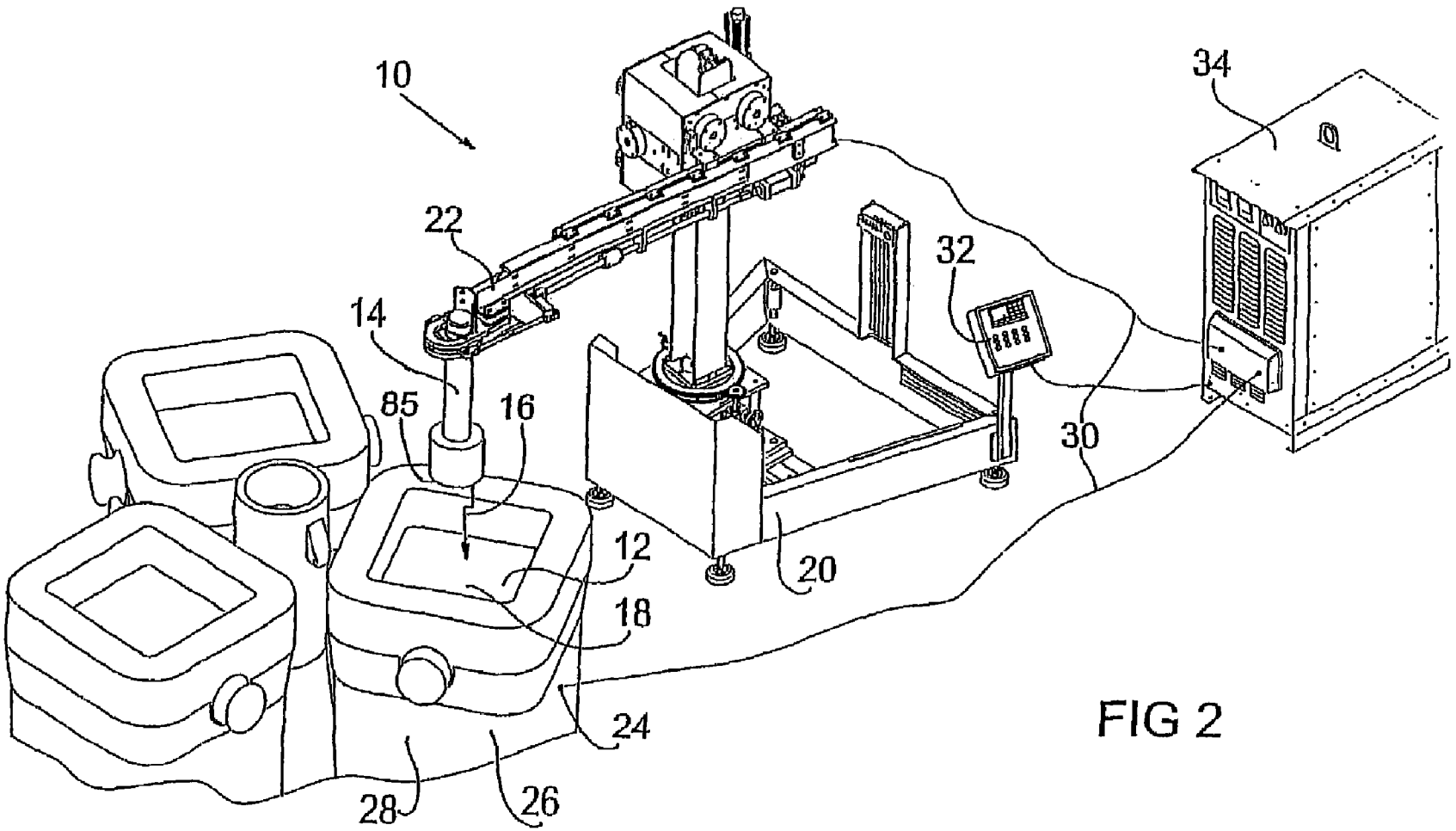
FIG. 2 is an elevational view of a preferred embodiment of the apparatus according to the invention.

In FIG. 2 there is seen an apparatus 10 for producing metal castings 12 using the method to be described with reference to FIG. 1. The apparatus 10 produces metallic castings having few or no voids, reduces inclusions, porosity and grain size and improves homogeneity, as will be described with reference to FIGS. 10–14.

The apparatus 10 supports an electric arc electrode 14, which when powered forms a moving electric arc 16 over the upper surface 18 of a liquid metal 12 being cast:

A stand 20 and arm 22 suspend the electrode 14 over the upper surface 18 after or during pouring. The arm 22 is height adjustable so that the electrode 14 can be positioned above the metal surface 18.

Figure 3:
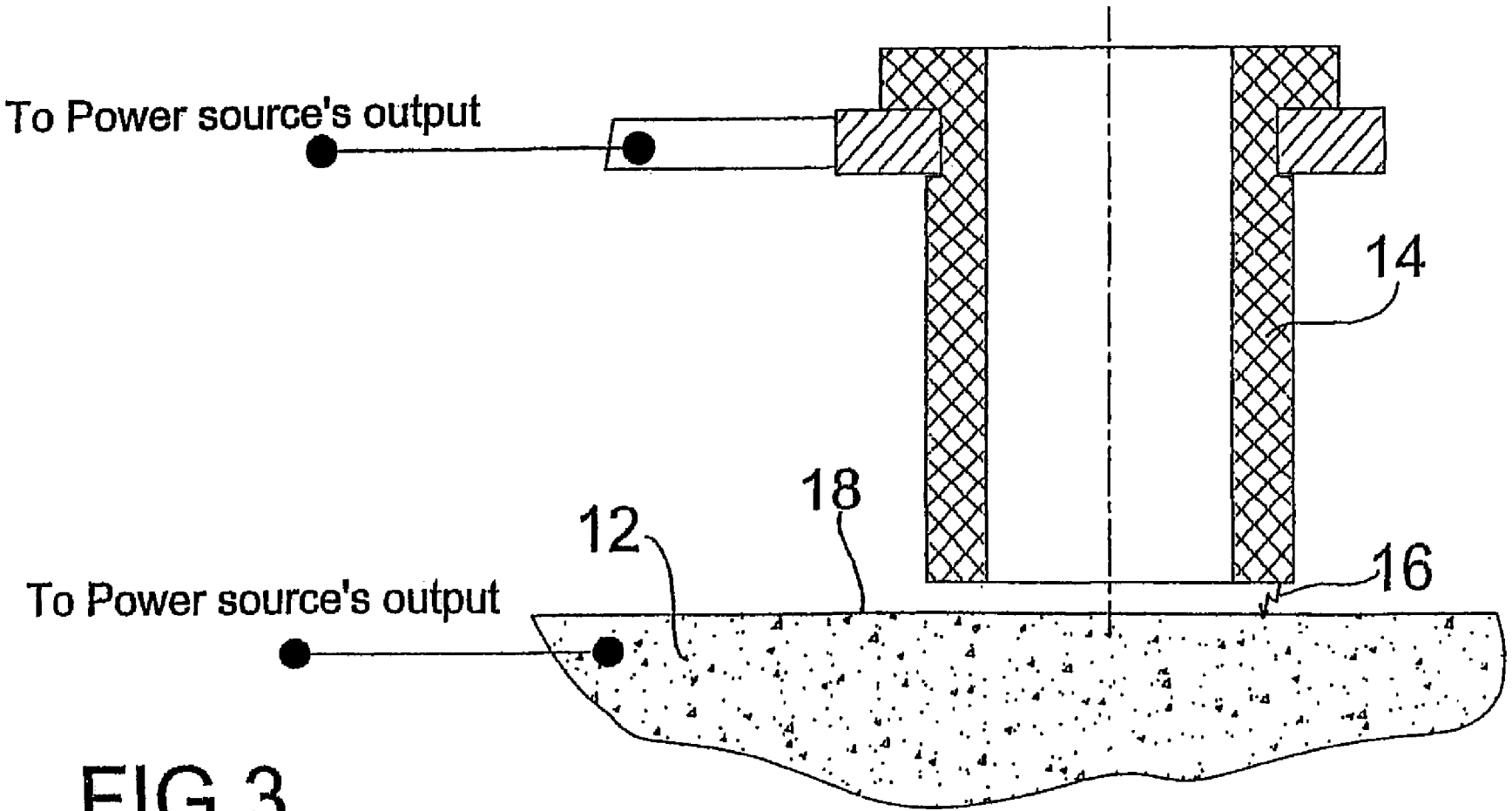
FIG. 3 is a detail sectional view of an electrode position over the liquid metal.

A second electrode 24 is attached to a metallic surface 26 of the mold 28 being used for casting, for completion of an electric circuit 30 including the electric arc 16, seen to better effect in FIG. 3. The mold 28 can be water-cooled.

Electronic controls 32 used to control current and arc movement are connected between the apparatus 10 and a power supply 34.

Preferably the power supply 34 produces DC current (AC current, RF stabilizer, etc are suitable as well) and is connected with the positive terminal to the electrode 14, the negative being connected to a metal part 26 of the mold 28.

With reference to the rest of the figures, similar reference numerals have been used to identity similar parts.

Figure 3A:
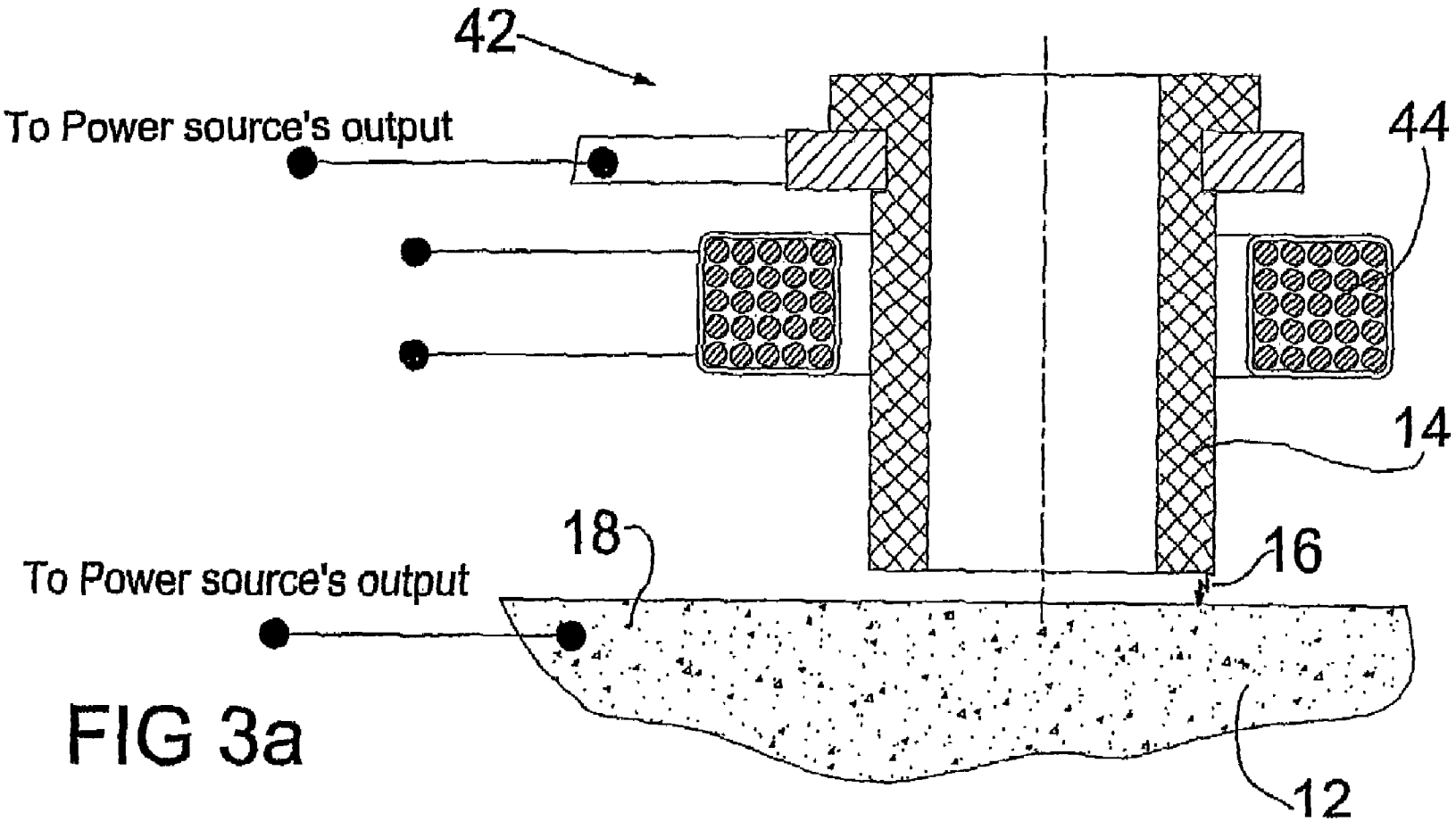
FIG. 3*a* embodiment provided with an electromagnetic coil for increasing the radial velocity of the electric arc.

Referring now to FIG. 3*a*, there is seen a detail of an electric arc casting apparatus 42 may include as an option an electric coil 44 adjacent to the electrode 14. When the coil 44 is powered it increases the radial movement of the electric arc 16 in a rotary motion over the surface 18 of the casting 12 and increases electric arc velocity.

Figure 4:
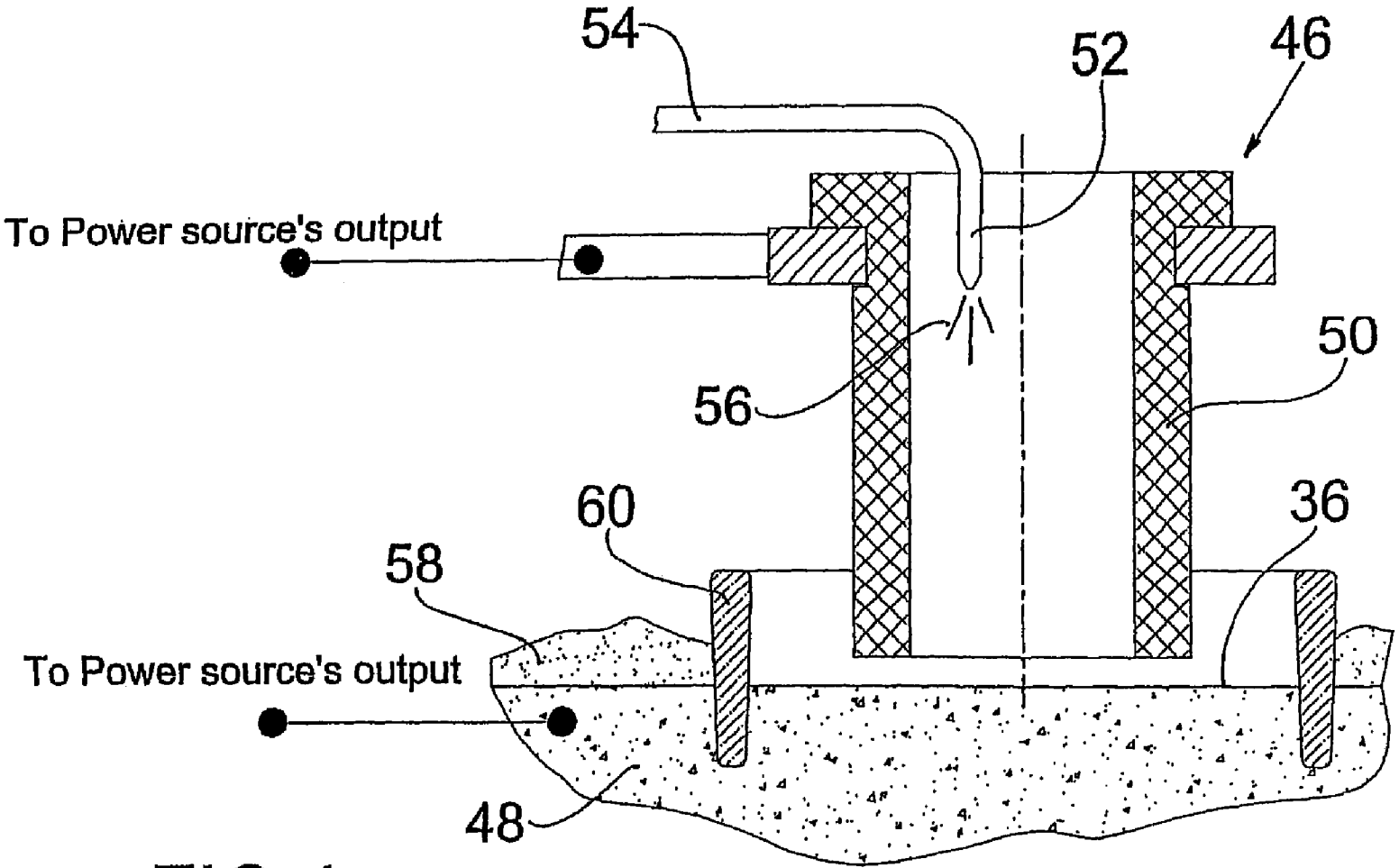
FIG. 4 is a sectioned detail view of an embodiment provided with an arrangement for preventing the casting powder from reaching the arc-working zone.

FIG. 4 illustrates a detail of a casting apparatus 46 for producing clean metallic castings—in a mold 28 as seen in FIG. 2. The electrode 50 is hollow, and large enough to accommodate a gas feed pipe 52. Tubing 54, and controls 32 seen in FIG. 2 direct a stream of an inert gas, such as argon, through the hollow of the electrode 50 over the upper surface 36 of the ingot 48 being cast The gas jet 56 serves to prevent the metal surface from oxidation and nitrogen pick-up, and for the removal of non-metallic impurities such as casting powder 58 from the upper surface 36.

Advantageously there is provided a refractory guard ring 60, preferably made of a ceramic material, which is positioned on the upper surface 36 of the ingot 48. The ring 60 maintains exclusion of the non-metallic impurities such as casting powder from the upper surface 36.

Figure 5:
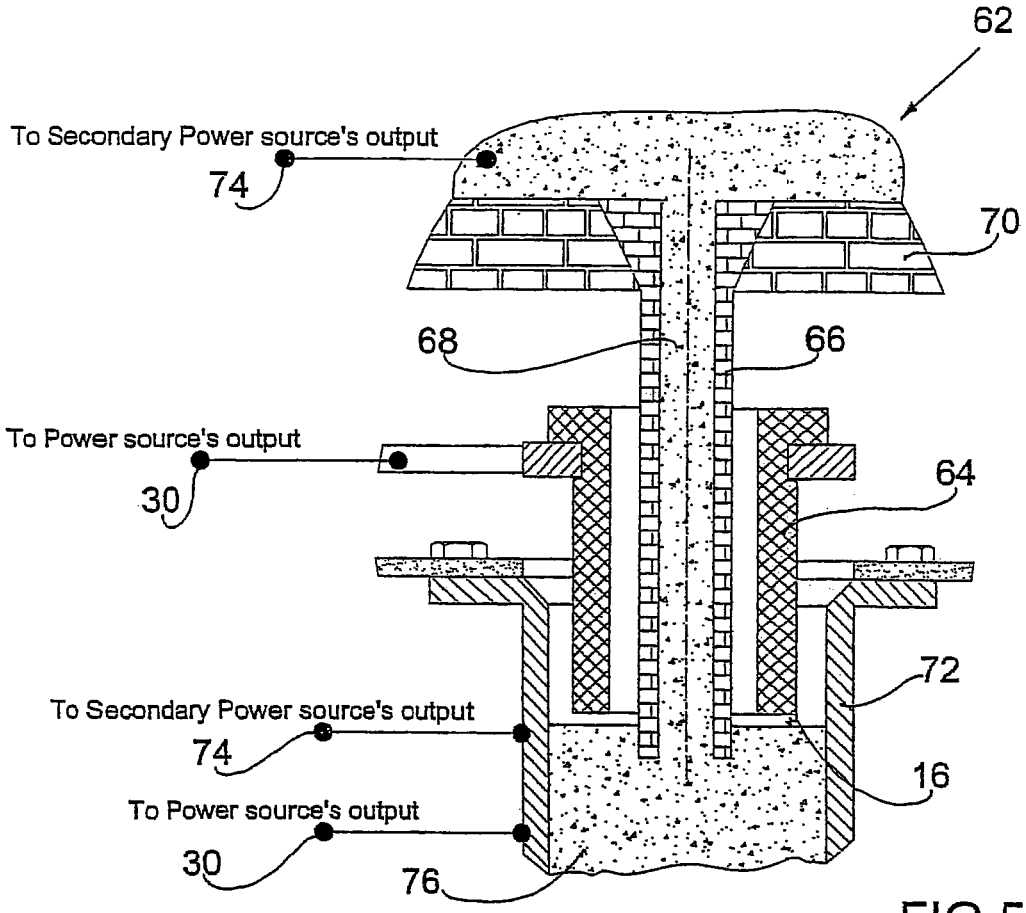
FIG. 5 is a sectional view of an embodiment Wherein metal is pored through the center of the electrode.

Referring now to FIG. 5, there is depicted a detail of a continuous casting apparatus 62. A hollow electrode 64 is sufficiently large to allow the insertion there through of the casting nozzle 66 receiving metal 68 from the tundish 70 there above and pouring the metal 68 into the mold 72. As an option at least a part of the mold 72 is metallic and serves as a component of an electric circuit 74 which magnetically urges the electric arc as in FIG. 1 towards the center of the casting 76.

The diagram shows two electric circuits 30, 74. The inner high-power circuit 30 provides power to form the electric arc 16. The outer low-power circuit 74 connects the tundish 70 to the mold 72 and is for stabilizing control of the electric arc, and directing the arc towards the center of the mold 72.

Figure 6:
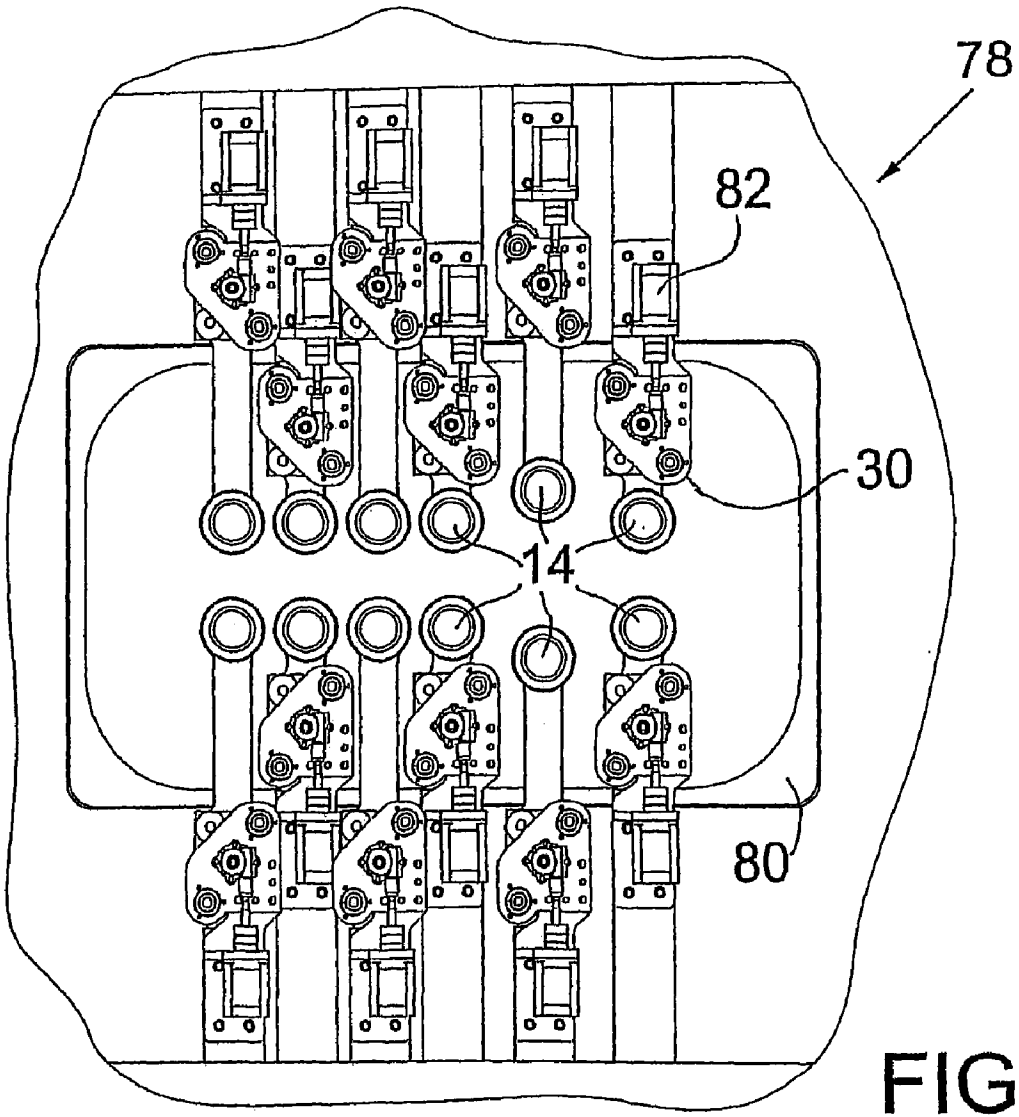
FIG. 6 is a diagrammatic plan view of an arrangement provided with multiple electrodes.

FIG. 6 shows a moving arc casting apparatus 78 provided with multiple electrodes 14. Each electrode 14 is positioned over one of the risers of a large sand or permanent mold casting 80, for example a cylinder heads. Each electrode 14 has a separate motor 82 and electric circuit 30 and is able to powers and produces its own moving electric arc over the riser at which it is positioned. As flow through the risers is greatly facilitated by the electric arc, fewer risers, and of smaller size, may be used in comparison with conventional casting. This subject will be further illustrated in FIG. 15, where the riser may be seen.

FIG. 1 to FIG. 4 are referred to as illustrating a method for reducing voids, inclusions, porosity and grain size in metallic castings and for improving homogeneity therein by use of a electric arc 16.

The method comprises the following steps.

STEP A. Pouring a liquid metal either ferrous or non-ferrous, into a mold 28 having an electrically-conductive component 26.

STEP B. Providing a electric arc electrode 14 and positioning same slightly above, typically 2–20 mm, above the upper surface of the molten metal.

STEP C. Applying an electric current to the electrode 14 to form an arc between the electrode 14 and the upper surface of the liquid metal 18. In the present preferred method, the current is DC. The arc moves continually the lower face 85 of the electrode 14, to stir the liquid metal, to break dendrites (FIG. 9) if present, and to maintain a central molten pool of metal to fill voids forming in the casting due to cooling shrinkage. The electric currents resulting from application of the arc are represented by arrows 5 in FIG. 1. A strong vortex is produced by this stirring, which allows gas bubbles and low-density inclusions to reach the casting surface.

Figure 7:
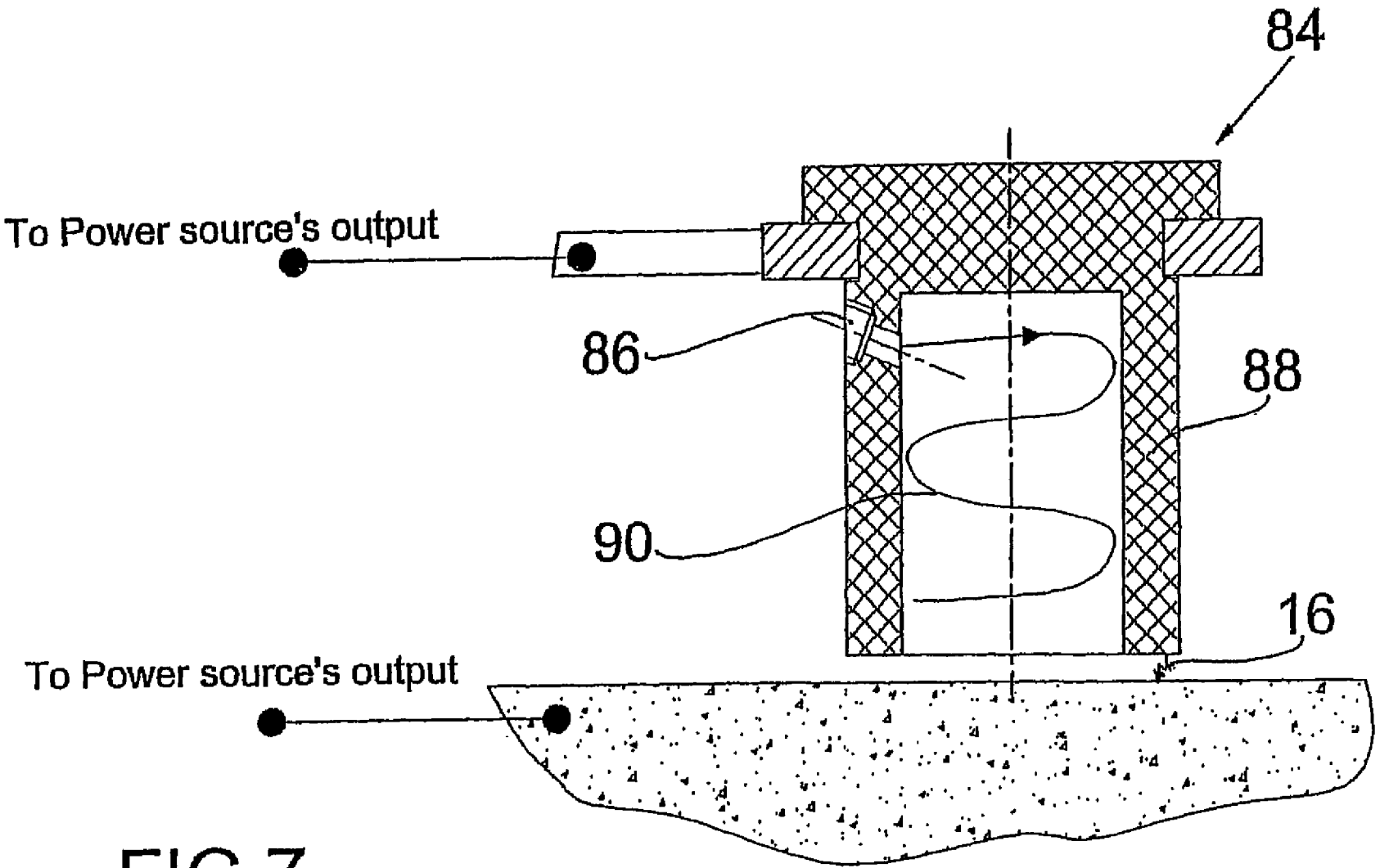
FIG. 7 is a schematic view of a rotating arc electrode by argon gas.

FIG. 7: shows electrode apparatus 84 for continuously rotate an electric arc 16 that includes two argon gas tubes 86 located inside a graphite hollow electrode 88 tangential to its contour. The vertical argon jets 90 force the arc 16 to rotate continuously, in addition preventing oxidation and nitrogen pick-up and removal of non-metallic material such as casting powder, as mentioned above.

Figure 8:
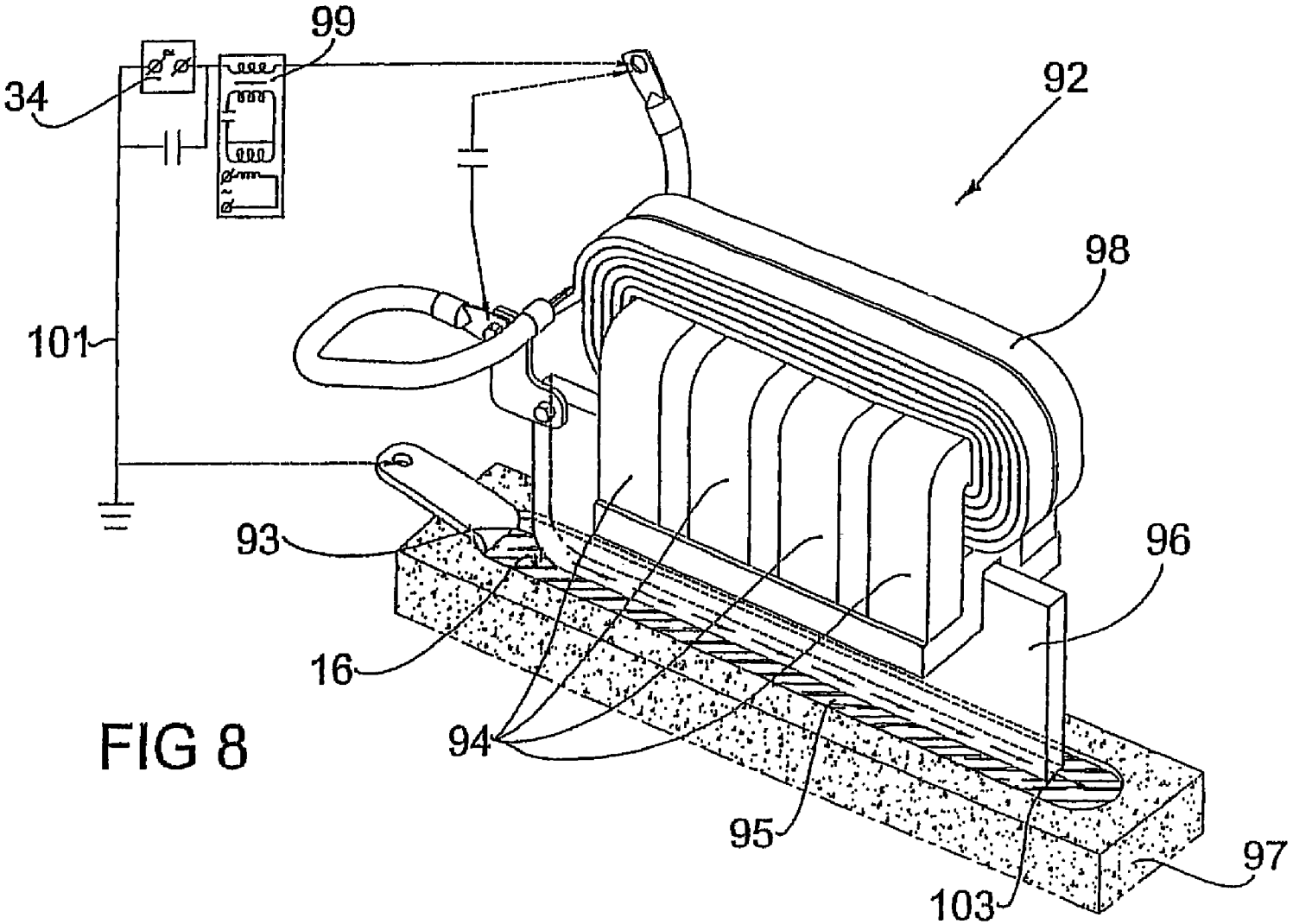
FIG. 8 is a schematic view of a knife shaped traveling arc electrode.

FIG. 8 illustrates knife shaped electrode 92 for continuously running an electric arc in singular direction when an elongated open arc path is needed, for example on an elongated mold 97. The apparatus contains a set of horse-shoe like ferromagnetic cores 94 a knife shaped electrode 96 and a set of coils 98. Applying electric current to the electrode 96 ignite an arc 16, the arc is then drives to run from ignition point 93 to the electrode other end 103 by a magnetic field creates by the coils 98 and the ferromagnetic core 94. In order to ignite an arc 16 it necessary to create a small gap between the electrode edge 93 and the surface of the molten metal 95. An arc 16 ignition is created by the aid of an oscillator 99 that connects to the electric circuit 101 that connects the electrode 96, the metal 95 and the magnet to the power supply 34. The arc originates at end 93 runs in high velocity along the electrode-working surface toward point 103. At point 103 the arc brakes and at the same time the oscillator ignites another arc at point 93.

Referring again to FIG. 1, FIG. 4, and also now to FIG. 5, there will now be described a casting method for metallic ingots (as well as continuous casting) 28 and 72, including the use of casting powder 58. Casting powder contains oxides and carbon, and is introduced into the mold 28 while pouring is taking place. The powder protects the metal from oxidization and serves as a lubricant between the mold walls and the ingot 48.

STEP A. Pouring a liquid metal 48 or 76 into a mold 28 or 72.

STEP B. Removing casting powder from the upper surface 36 of a liquid metal in an ingot 48 being cast by blasting an inert gas such as argon thereover. Preferably a stream of the inert gas is retained until casting is finished to protect the casting from oxidization and nitrogen pickup while still partially liquid.

STEP C. Preventing the return of the casting powder by placing a refractory guard ring 60 on the upper surface 36 of the casting.

STEP D. Providing an electric arc electrode 50 and positioning same slightly above the upper surface 36 of the molten metal.

STEP E. Applying an electric current to the electrode 50 to form an electric arc 16 between the electrode 50 and the upper surface 36, so as to stir the liquid metal 48, to break coarse dendrites if present, to allow light-density impurities including gases to reach the upper surface, and to maintain a central molten pool of metal to fill voids forming in the casting due to cooling shrinkage.

STEP F. Continually moving the electric arc 16 over the upper surface. Such movement takes place automatically with a correctly formed electrode 50.

Referring again to FIG. 6, the following casting method is used to produce a large sand casting 80, metal being fed through a plurality of risers.

STEP A. Casting a liquid metal into a mold 80.

STEP B. Providing a plurality of spaced-apart electric arc electrodes 14 and positioning each electrode 14 slightly above the upper surface of each riser.

STEP C. Applying an electric current to the electrodes 14 to form a moving plasma between the electrodes and the upper surfaces of the liquid metal.

Figure 9:
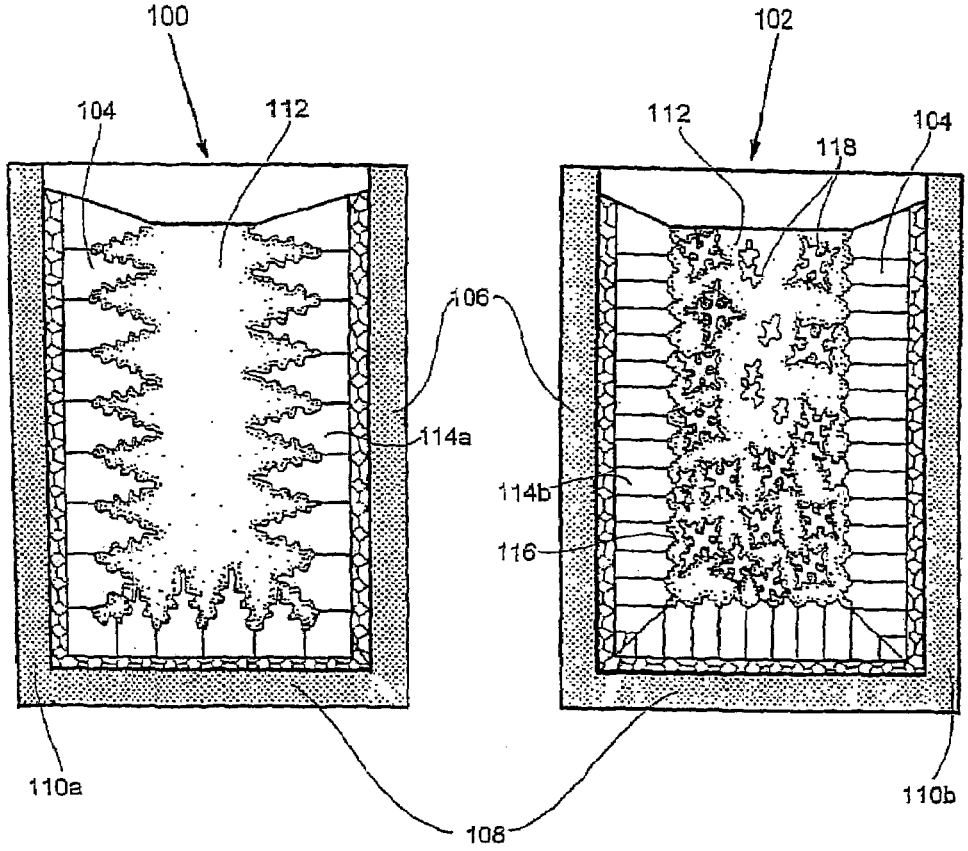
FIG. 9 is a comparison of dendrites in conventional casting and casting according to the present invention, the size of the grains and dendrites being greatly exaggerated.

Referring now to FIG. 9, there is depicted the solidification process of two castings 100, 102 in the process of forming dendrites 104, which are shown on a very large scale for illustrative purposes. The diagrams show solidification adjacent to the walls 106 and bottom 108 of the mold 110 molten metal 112 remaining in its center region. The mold 110*a* shown on the left contains a conventional casting which has wide columnar growth zones 114*a* staring at the mold walls 106 and ending in dendrites 104. The mold 110*b* shown on the right holds a casting 102 which has been produced by the method of the present invention. There are seen narrow columnar growth zones 114*b* starting at the mold walls 106 and ending in broken-off dendrites 116, the branch segments 118 forming small new crystals. The dendrite branches were broken up by the stirring action of the traveling arc plasma, and serve to form small new crystallization centers.

Figure 10:
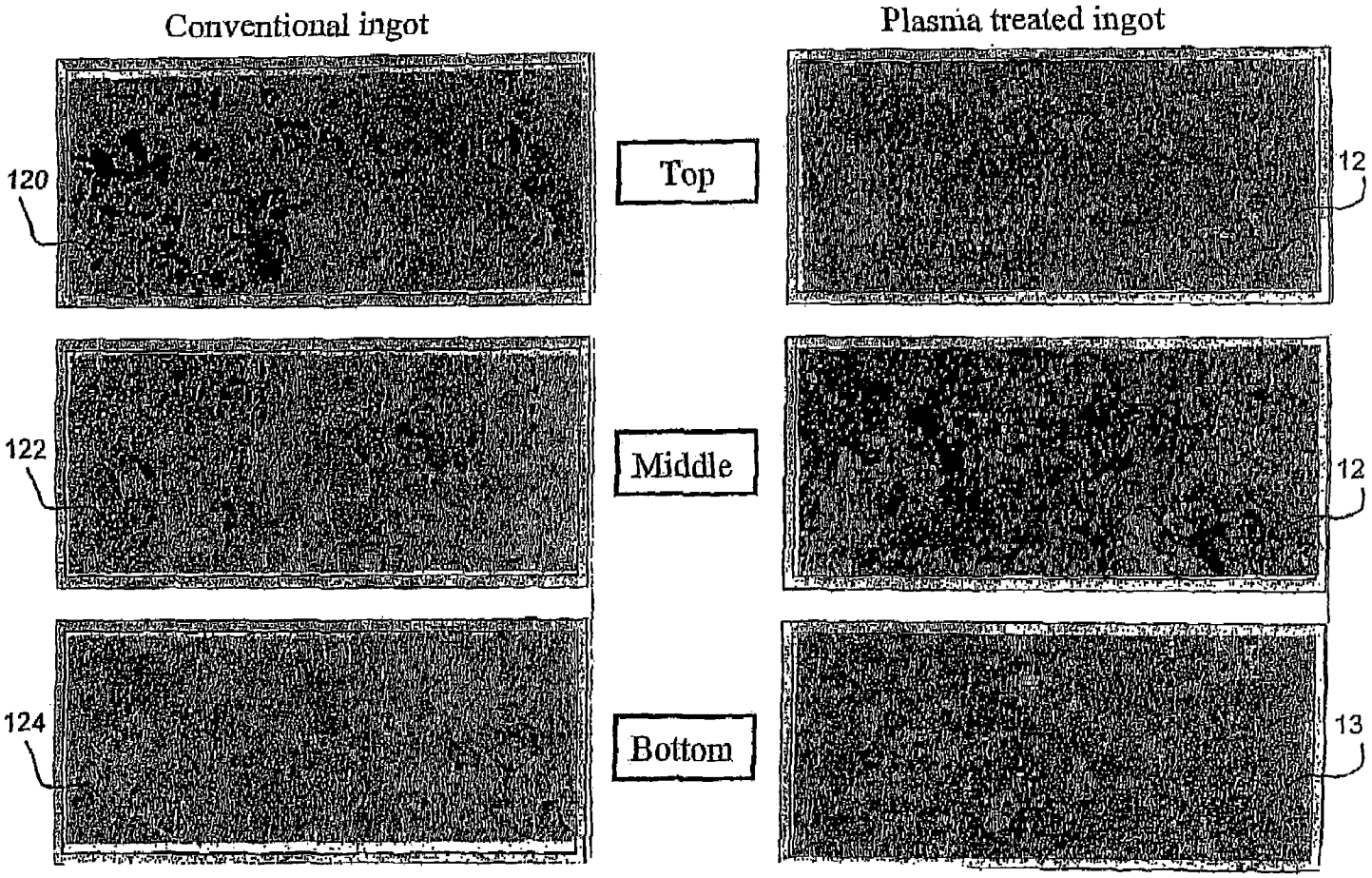
FIGS. 10 and 11 comprise comparative photographs of 10 ton tool steel ingot grain structure.

FIG. 10 shows the microstructure of two 10 ton tool steel ingots. Samples were cut from locations at the center of the ingot from near the top, the middle and bottom of each ingot. Diagrams are etchings at 50× magnification. On the left side are photographs 120, 122, 124 of the etchings taken from a conventionally cast ingot, showing a coarse grain structure and poor homogeneity. On the right side are photographs 126, 128, 130 of the etchings taken from a cast ingot produced by the method of the present invention, showing a finer grain structure and much improved homogeneity.

Figure 11:
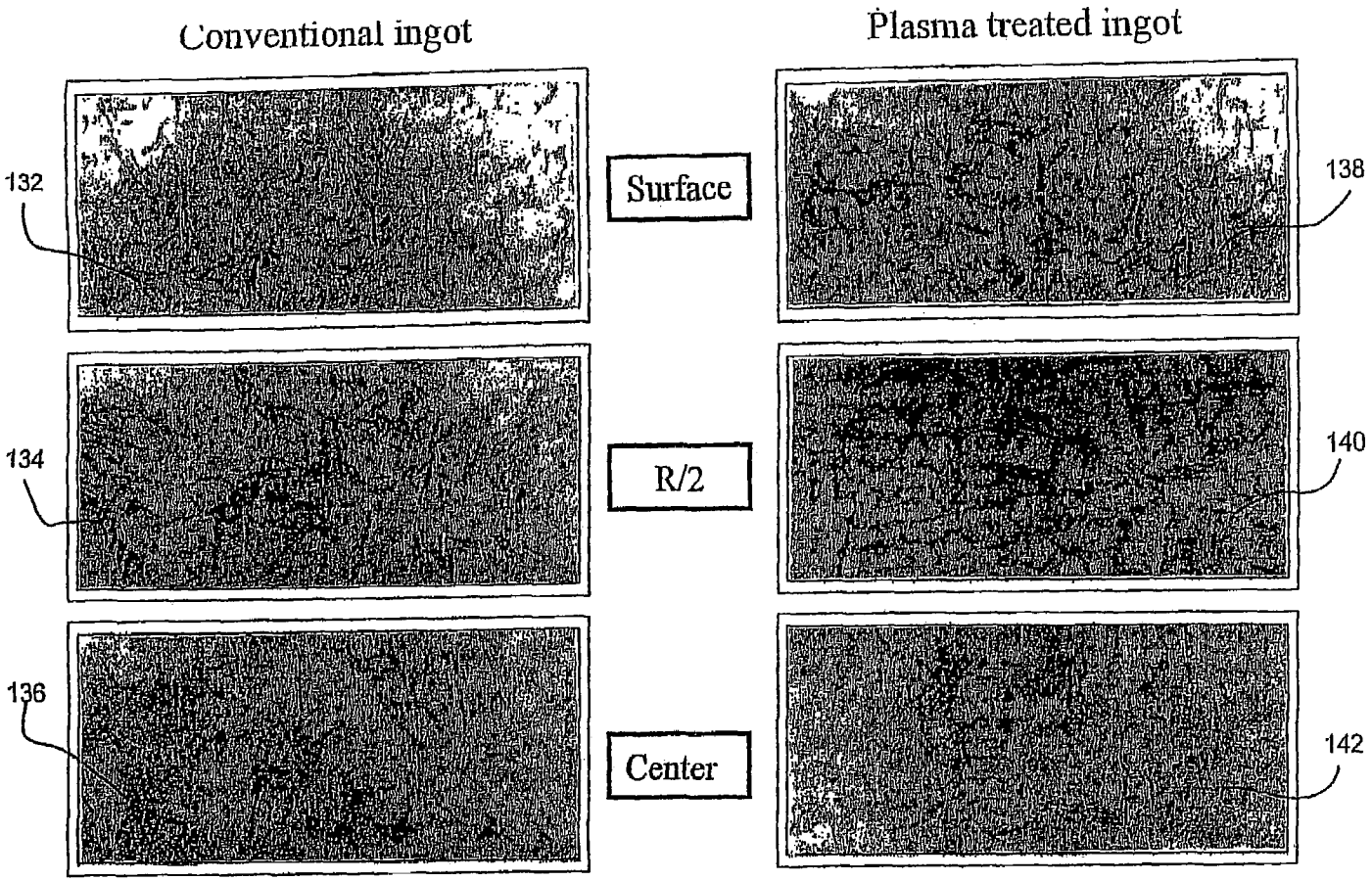

FIG. 11 shows the microstructure of two 10 kg AlSilOMg ingots. Samples were cut from a location near the top of the ingot. Diagrams are etchings at 125× magnification. On the left side are photographs 132, 134 136 taken of etchings taken from a conventionally cast ingot, showing a coarse grain structure and poor homogeneity. On the right side are photographs 138, 140 142 of etchings taken from a cast ingot produced by the method of the present invention, showing a finer grain structure and much improved homogeneity.

Figure 12:
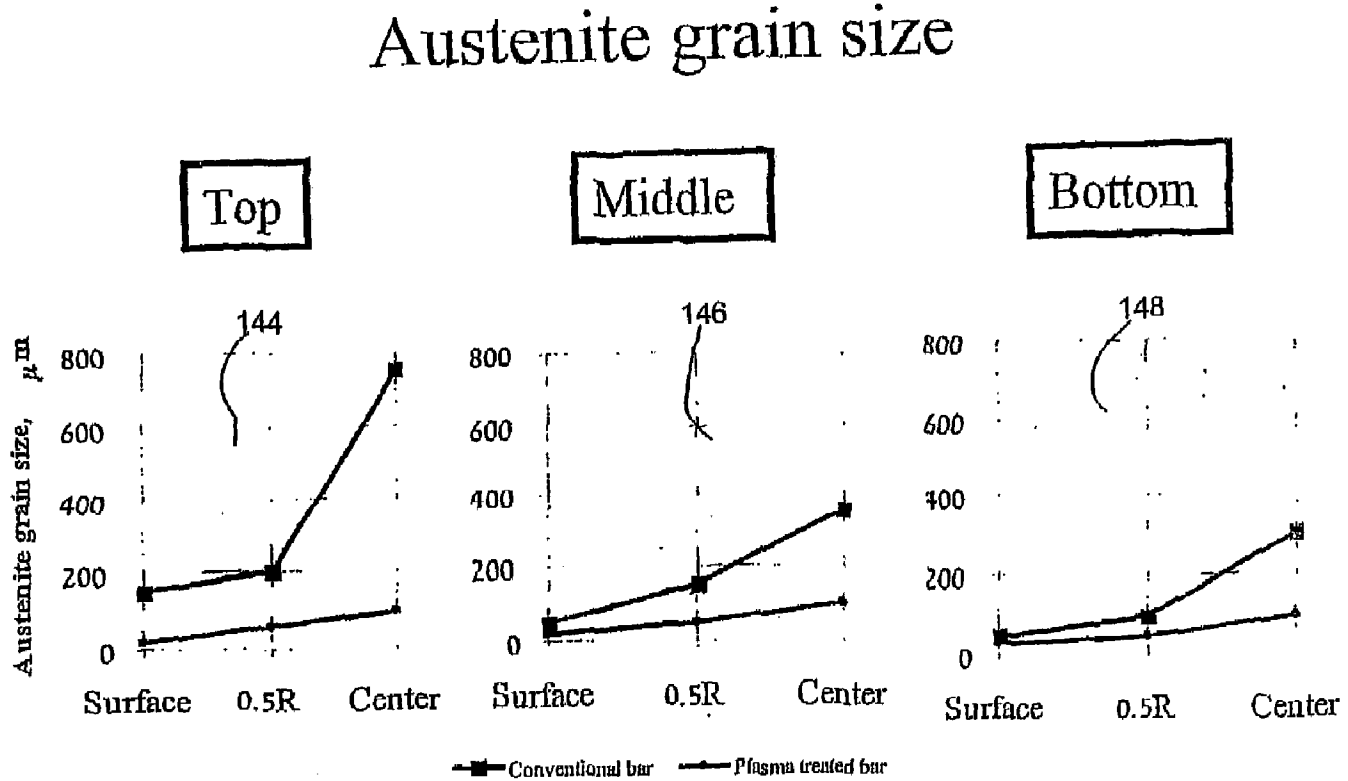
FIG. 12 shows graphs depicting and comparing austenite grain size.

FIG. 12 graphs shows the austenite grain size of two tool-steel bars, as measured at three locations regarding length 144, 146, 148 and regarding radius, giving nine measurements for each bar. Austentite, or gamma iron, is a solid solution of carbon in iron, and its grain size is of importance in any steel that is to be heat-treated. The graph lines joining the squares refer to a steel bar made from a conventionally cast ingot. The lines connecting the round dots refer to an ingot treated by the method of the present invention. The results shown that grain size is reduced at all positions, the improvement ranging from negligible at the bottom center of the ingot to an improvement by a factor of 7 at the center top thereof.

Figure 13:
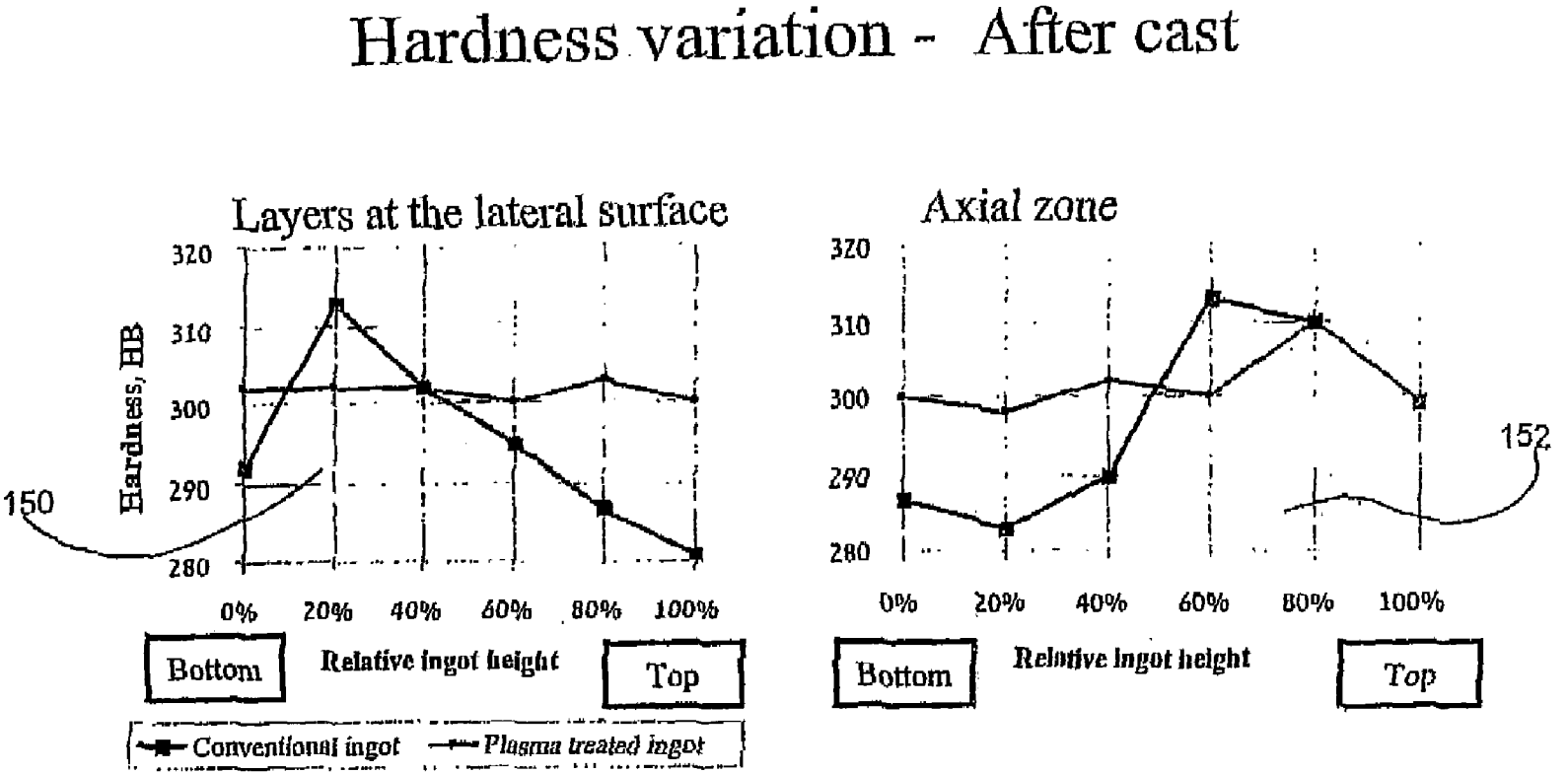
FIG. 13 shows graphs depicting and comparing hardness at various ingot locations.
Figure 14:
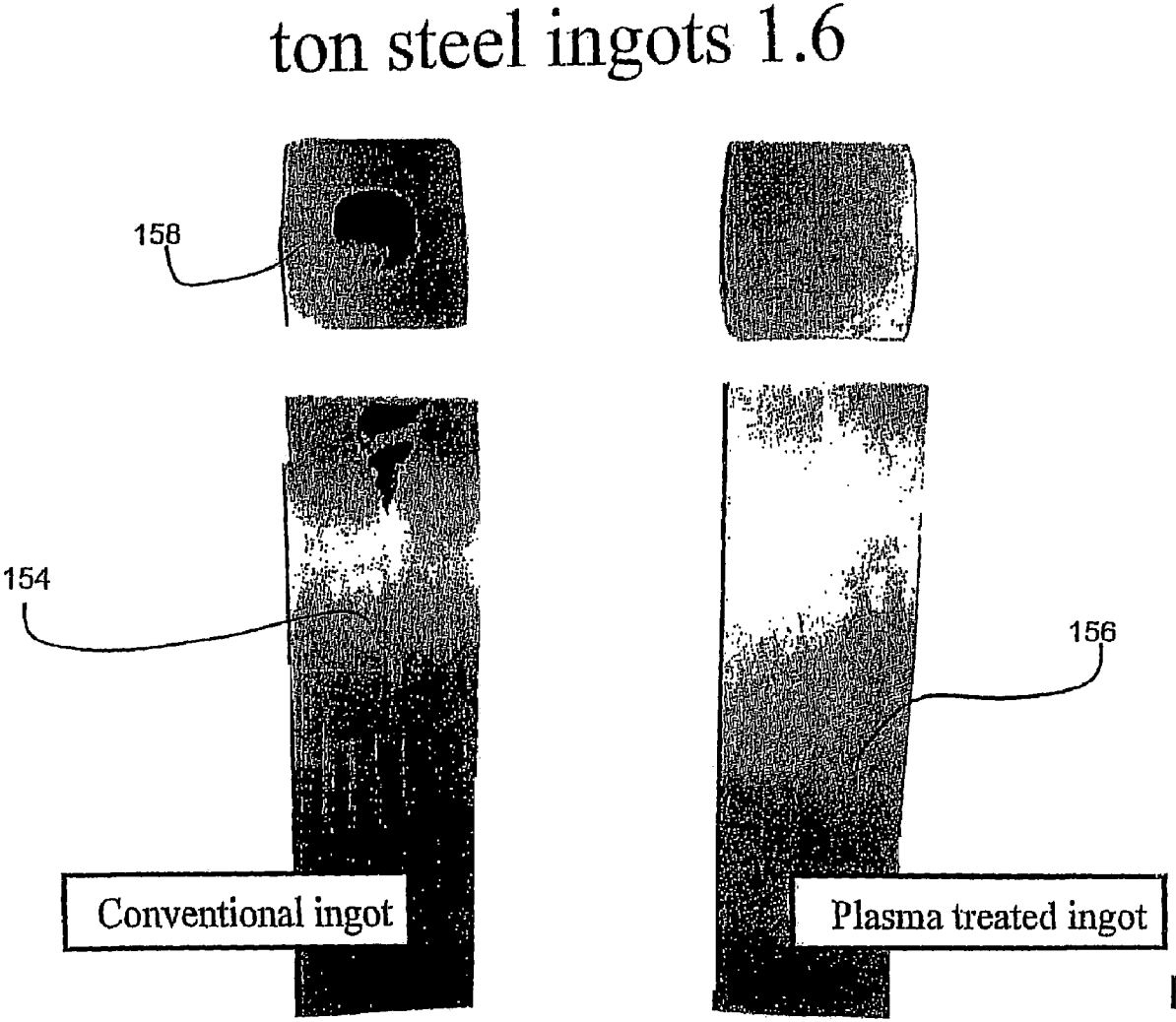
FIG. 14 is a comparison of ingot voids in conventional casting and casting according to the present invention.

Seen in FIG. 13 are comparison graphs relating to the hardness of two 1.6 ton steel ingots 154, 156 seen in FIG. 14. Hardness was measured at the lateral surface 150 and axial zone 152 for each ingot at six heights from the ingot bottom. As in FIG. 11, the graph lines joining the squares refer to an ingot made from a conventional casting, while the lines connecting the round dots refer to an ingot treated by the method of the present invention. The conventionally cast ingot shows much higher variation than the ingot produced by the method of the present invention.

Referring now to FIG. 14, there are seen photographs of the two 1.6 steel ingots 154, 156 previously referred to in FIG. 13, after being cut axially through their center and polished. The conventionally-cast ingot 154 shows substantial voids 158 due to shrinkage blowholes. No voids are evident in the ingot 156 cast according to the method of the present invention.

Figure 15A:
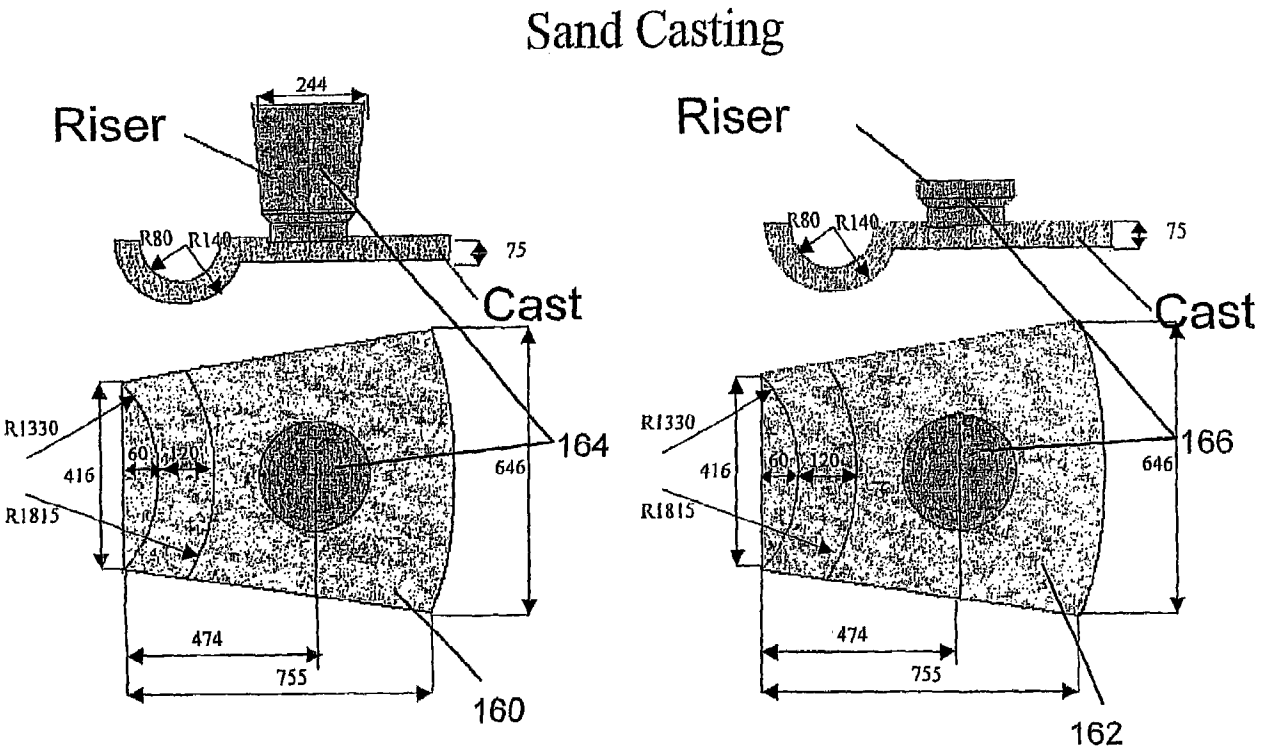
FIG. 15 is a comparison of riser size in conventional sand casting and the same sand casting cast according to the present invention.

FIG. 15*a* shows two steel sand castings 160, 162, outer dimensions of each being approximately 800×650 mm and wall thickness between 50 and 75 mm. The castings 160, 162 weighed 310 kg each, and were cast through a single riser 164, 166 each. The casting 160 on the left was produced by conventional means, the riser 164 being discarded weighing 140 kg. The casting 162 on the right side was produced using the method of the present invention, which made possible the use of a riser 166 which when discarded weighed only 26 kg.

Figure 15B:
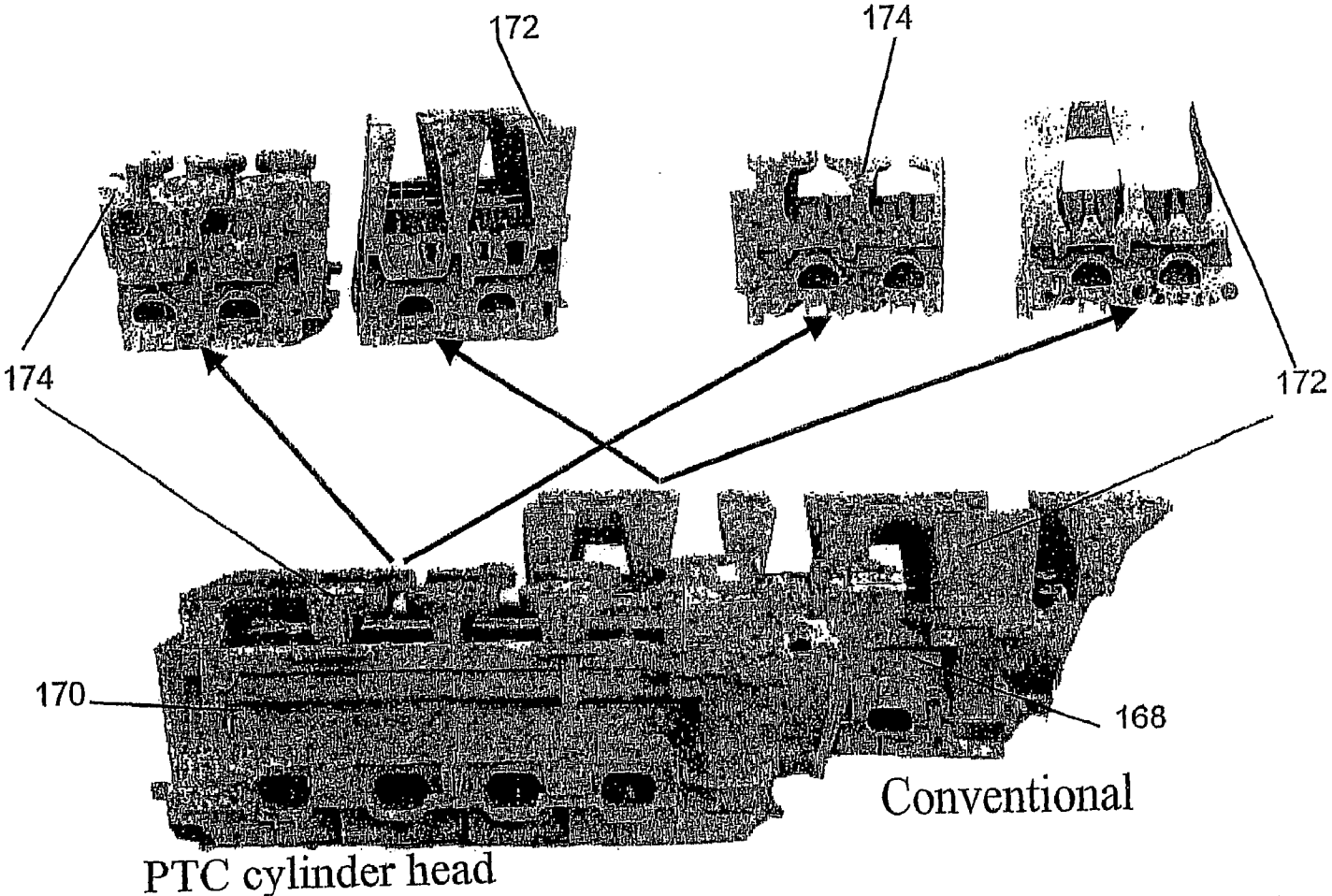

FIG. 15*b* shows two aluminum cylinder head sand castings 168, 170. The castings have 10 raisers 172, 174 each. Casting 168 was cast by conventional means and full size risers while casting 170 was cast applying the method of the present invention, acting on each raiser using apparatus 78 as was seen in FIG. 6. The raiser mass was reduced by 73%.

The scope of the described invention is intended to include all embodiments coming within the meaning of the following claims. The foregoing examples illustrate useful forms of the invention, but are not to be considered as limiting its scope, as those skilled in the art will readily be aware that additional variants and modifications of the invention can be formulated without departing from the meaning of the following claims.

The invention claimed is:

1. A process for improving cast metals and alloys quality and casting yield, said process comprising:

pouring molten metal into a mold;

positioning an electric arc electrode above an upper surface of said molten metal, during or after pouring the metal into said mold; and applying a moving arc over said upper surface of the molten metal during solidification, by applying to the electrode an electric current to stir molten metal in the mold in such an intensity as to break up coarse dendrites into smaller solids.

2. A process as claimed in claim 1 for inducing internal flow in said molten metal, resulting in at least one of the following effects: reducing inclusions, porosity, shrinkage blowholes and grain size and improving homogeneity in east metals and alloys.

3. A process as claimed in claim 1 for reducing riser size and/or number in sand and permanent mold casting.

4. The process us claimed in claim 1 for metallic ingots casting comprising:

pouring the molten metal into said mold.

5. The process as claimed in claim 1 for metallic ingots casting including the use of casting powder comprising:

removing casting powder from the upper surface of an ingot being cast; and preventing return or said casting powder by placing a refractory guard ring on said upper surface of a melt, thereby surrounding a working area in the vicinity of said electrode.

6. The process as claimed in claim 1 for continuous or semi-continuous casting, comprising:

pouring the molten metal into a tundish; and continuously pouring the metal from the tundish into the mold for casting slabs, billets or blooms.

7. The process as claimed in claim 6, further comprising providing a second electric circuit between said the tundish and the mold.

8. The process as claimed in claim 5 for continuous or semi-continuous casting including the use of casting powder comprising pouring the molten metal into a tundish; and continuously pouring the metal from the tundish into the mold for casting, slabs, billets or blooms.

9. The process as claimed in claim 8 further comprising providing a second electric circuit between said the tundish and the mold.

10. A process as claimed in claim 1 or 3 for sand or permanent mold casting having a plurality of risers, comprising:

providing a plurality of electric arc electrodes and positioning electrodes slightly above the upper surface of the selected risers; and applying an electric current to said electrodes to form moving arcs between said electrodes and the upper surfaces of the liquid metal.

11. A process as claimed in claim 1 for applying multiple arcs over one large cast comprising:

providing a plurality of electric are electrodes and positioning electrodes slightly above the upper surface of the cast at the preferred positions; and applying an electric current to said electrodes to form moving arcs between said electrodes and the upper surfaces of die liquid metal.

* * * * *